United States Patent [19]

Tenconi

[11] 3,975,926

[45] Aug. 24, 1976

[54] FEED DEVICE FOR CIRCULAR KNITTING MACHINES OF THE TYPE MANUFACTURING OPEN FABRIC

[76] Inventor: Riccardo Tenconi, Via Tallera, 20, Varese, Italy

[22] Filed: Feb. 24, 1975

[21] Appl. No.: 552,492

[52] U.S. Cl. ..... 66/133; 66/131; 66/19

[51] Int. Cl.[2] ..... D04B 15/58

[58] Field of Search ..... 66/125 R, 145 R, 135, 66/131, 133, 134, 138, 140 R, 19

[56] References Cited

UNITED STATES PATENTS

| | | | |
|---|---|---|---|
| 2,688,862 | 9/1954 | Rizzo | 66/135 |
| 2,920,467 | 1/1960 | Dantzler et al. | 66/138 |
| 2,974,505 | 3/1961 | Levin | 66/135 |
| 3,006,173 | 10/1961 | Shoaf | 66/145 R X |
| 3,256,715 | 6/1966 | Monday | 66/133 |
| 3,298,203 | 1/1967 | Schmidt et al. | 66/131 |
| 3,406,541 | 10/1968 | Robbins | 66/138 |
| 3,407,631 | 10/1968 | Abrams | 66/138 |
| 3,461,691 | 8/1969 | Ballard | 66/125 R |
| 3,521,466 | 7/1970 | Tannert | 66/19 |
| 3,596,851 | 8/1971 | Vincoli | 66/125 R X |
| 3,625,027 | 12/1971 | Piana et al. | 66/19 |
| 3,636,732 | 1/1972 | Townsend et al. | 66/133 |
| 3,640,094 | 2/1972 | Piana et al. | 66/19 |
| 3,681,941 | 8/1972 | Burdett et al. | 66/19 |
| 3,733,858 | 5/1973 | Gasparri | 66/145 R |

FOREIGN PATENTS OR APPLICATIONS

| | | | |
|---|---|---|---|
| 2,005,518 | 8/1971 | Germany | 66/125 R |
| 262,241 | 12/1926 | United Kingdom | 66/131 |

*Primary Examiner*—Mervin Stein
*Assistant Examiner*—Andrew M. Falik
*Attorney, Agent, or Firm*—Guido Modiano; Albert Josif

[57] ABSTRACT

A thread feed device for a circular knitting machine of the type having a fixed needle cylinder and needle dial and rotatable cams, for manufacturing open fabric. The needle cylinder and needle dial have a needle-free sector and the feed device comprises a stationary support for a plurality of thread spools, and a plurality of thread guides and levers arranged adjacent the needle-free sector. The thread guides and the levers associated therewith are selectively pivotable between a position in which they feed a selected thread to the needles and a position in which they hold the thread in a non-feeding position. Each thread is fed to the needles by means of a rotatable hooked member which entrains the thread around the needle cylinder. Each thread after being fed to the needles and having been knitted thereby is cut before reaching the needle-free sector.

10 Claims, 14 Drawing Figures

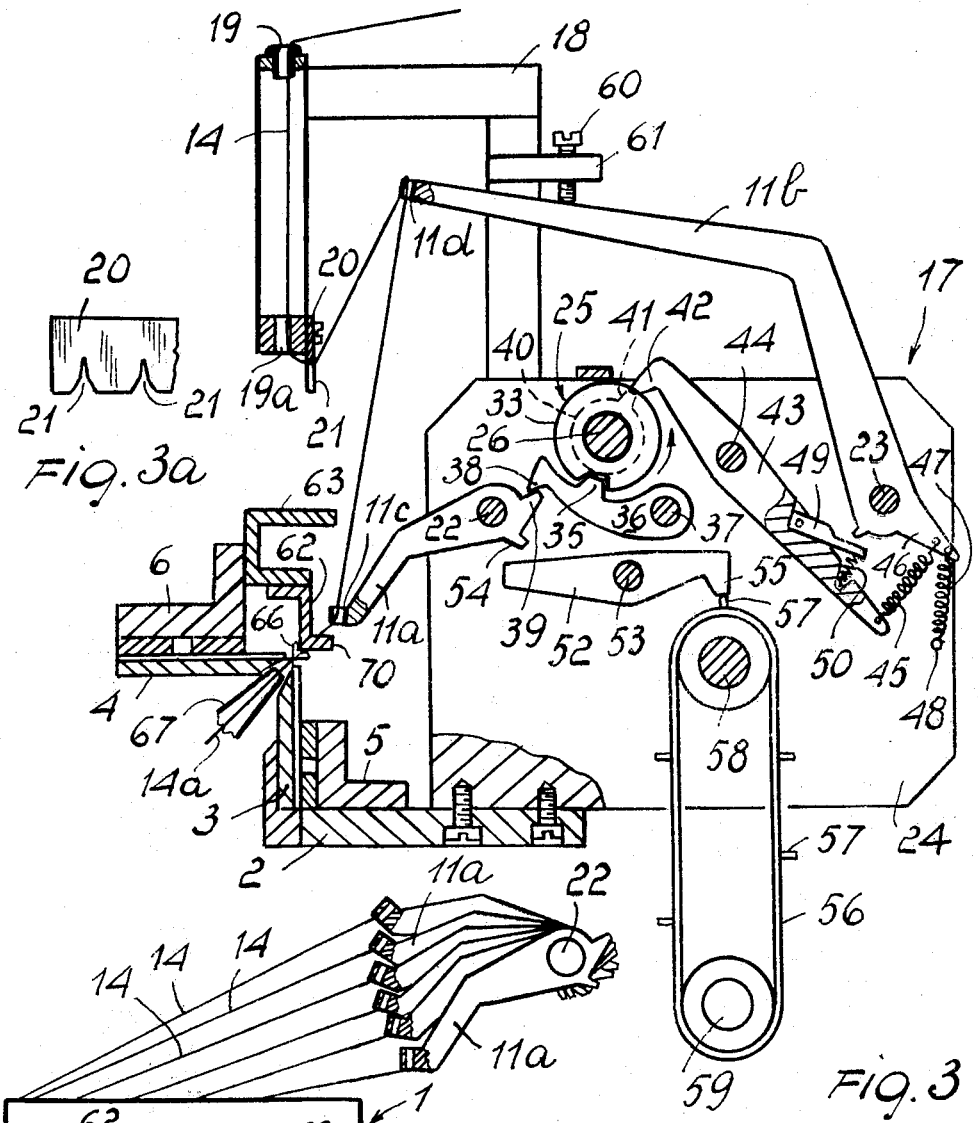
Fig. 3a
Fig. 3
Fig. 6
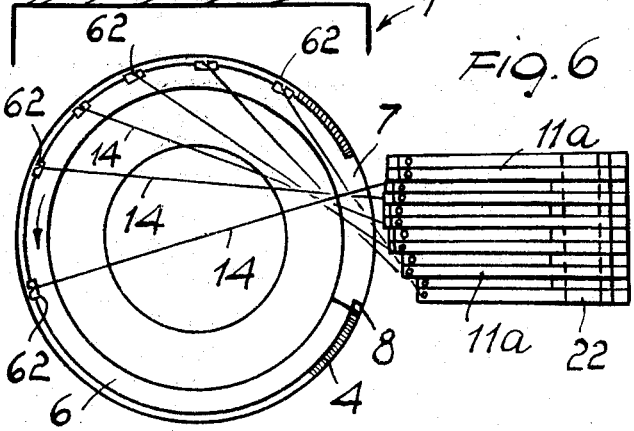
Fig. 7

FEED DEVICE FOR CIRCULAR KNITTING MACHINES OF THE TYPE MANUFACTURING OPEN FABRIC

This invention relates to a thread feed device for circular knitting machines of the type having a fixed needle cylinder and needle dial and rotating cams for manufacturing open fabric.

A machine of this type is described in U.S. Pat No. 3,521,466. This machine comprises a needle cylinder and needle dial having a sector without needles, and the knitted fabric produced is not of tubular form but has two lateral ends at the cylinder lines which separate the needled zone from the needle-free zone. Each thread which has formed a row of knitting is cut at one of these lines, and at the other line this same thread or another selected thread is again inserted into the knitting process to form another row of knitting. A cutting device applicable particularly to these machines is described in U.S. Pat. No. 3,640,094. It also comprises a pincer gripping unit for clamping the thread for cutting.

These machines have a large number of feeds, normally 12 but sometimes more, comprising a plurality of thread spools and respective thread guides above the needle cylinder on one or more spool holders rotating with the cam ring. The thread guides are normally grouped into a number of groups, each group being associated with a feed and normally comprises four or five different threads, for example of different color or type. The large number of feeds on the one hand gives the great advantage of a high production rate of knitted fabric, but on the other hand gives rise to considerable problems.

With 12 feeds each of five different threads, there are in fact 60 thread spools with 60 feeding units, the whole being rotatably supported above the needle cylinder. The rotating mass is considerable, and it is seldom balanced because of the different weight of the spools and the different degree of use when a pattern is made on the knitted fabric in which one color prevails over one or more other colors. This entire rotating mass is cantilever mounted so that the fabric produced can be discharged as an open sheet below the machine and along an arc of this latter. This arrangement naturally gives rise to greater stresses in the support structure.

It must also be considered that to replace an empty spool, the machine must be stopped each time. This stoppage not only gives rise to considerable production losses but also involves relatively long starting and braking times for the machine because of the considerable masses to be accelerated and braked each time. To reduce the frequency of stoppages for replacing used spools, it would be necessary to increase the capacity of these spools and therefore the weight of the rotating structure, which would render the operating conditions of the machine even more critical.

The main object of the present invention is to provide a feed device for a circular knitting machine of the type heretofore specified, which enables any number of feeding units, even much greater than the maximum number of feeding units at present possible, to be disposed without encountering the aforementioned difficulties and with the possibility of considerably increasing production.

A further object of the invention is to provide a feed device in which it is not necessary to stop the machine for replacing empty spools and in which spool replacement may be largely deferred in time.

A further object of the invention is to provide a feed device in which not only thread spools of large size and weight can be used, but also spools of much different sizes and weights, without any difficulty for the rotating machine structure.

A further object of the invention is to provide a feed device also applicable to conventional knitting machines of the type initially specified and which affects all the patterned effects attainable with these conventional machines.

These and further objects are attained by a feed device for circular knitting machines of the type having a fixed needle cylinder and neelde dial and rotating cams, the needle cylinder comprising a needle-free zone and a device for cutting the thread at the beginning of said zone, and a plurality of feeding units comprising a plurality of spools of thread and respective thread guides, the device being characterized in that said plurality of spools is arranged on a fixed structure to the side of the machine, and said thread guides are arranged in the proximity of the needle cylinder at said needle-free zone and are selectively approachable to said needle cylinder to selectively feed the needles with a thread previously cut by said cutting device, guide means being provided on the rotating machine structure for taking the thread fed by said selected thread guides and for feeding said thread to the needles around the needle cylinder.

Further characteristics and advantages of the invention will be more evident from the following description of a preferred embodiment of a device according to the invention, given by way of example and illustrated in the accompanying drawings in which:

FIG. 1 is a view of the machine and feed device from above;

FIG. 1*a* is a detail of FIG. 1 to an enlarged scale;

FIGS. 2 and 3 are side views of the feed device in two working positions. For simplicity only one thread guide and the members associated therewith have been shown, the machine however being provided with a large number of these thread guides and associated members.

FIG. 3*a* is a frontal view of a detail of FIGS. 2 and 3;

FIG. 4 shows the guide means for the thread, rotating with the rotating machine structure, during the formation of the knitted fabric;

FIGS. 5*a*, 5*b*, 5*c*, 5*d*, 5*e* and 5*f* are diagrammatic illustrations of the successive working stages of the feed device;

FIG. 6 is a side view of the arrangement of some operative thread guides, this arrangement having been exaggerated, for the purposes of example, as to the angular position of one thread guide relative to another;

FIG. 7 is a diagrammatic view of the machine from above, showing the various positions assumed by some of the threads fed to the needles during rotation of the rotating structure and formation of the knitted fabric.

Figure 1:
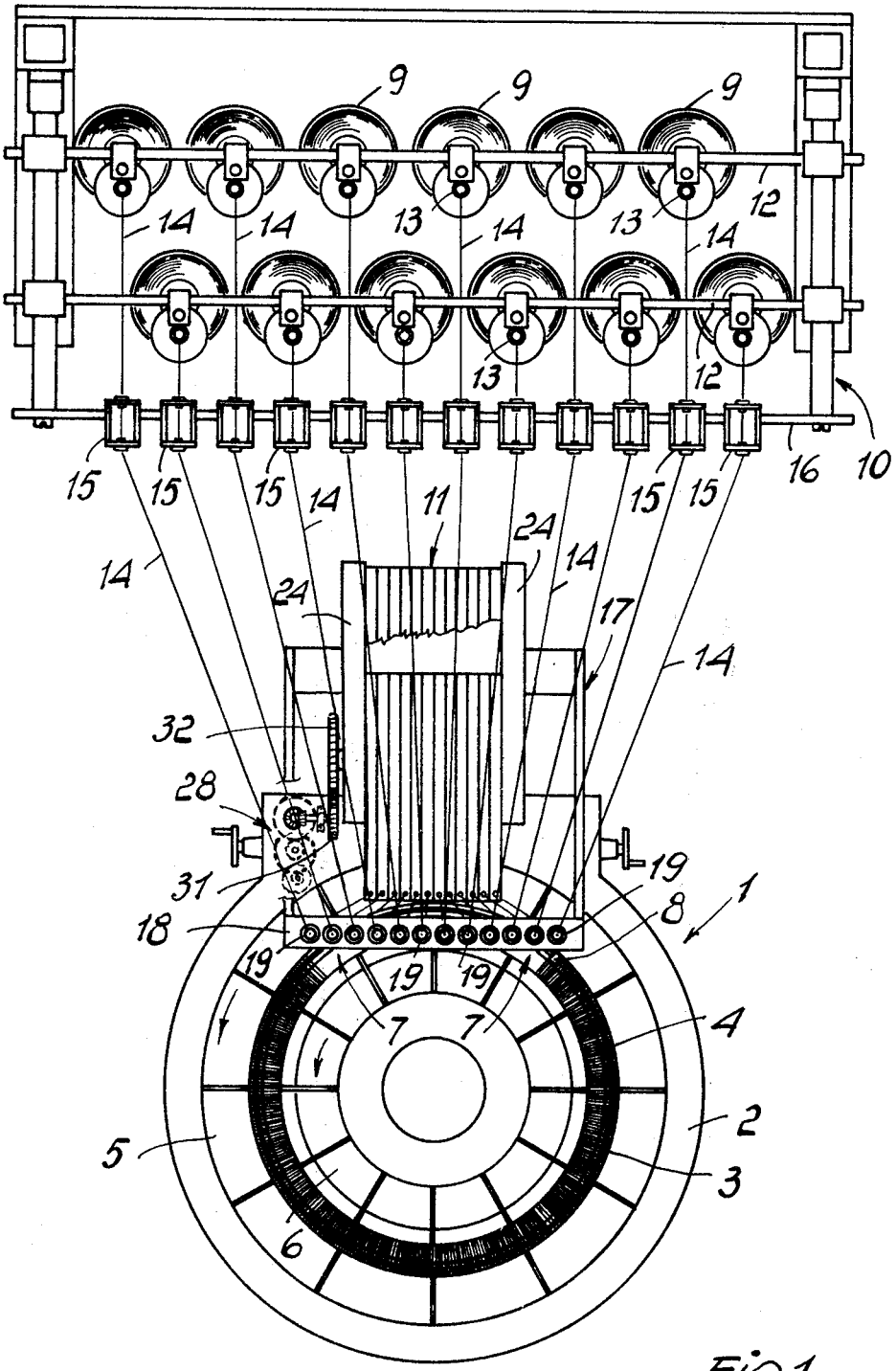

The circular knitting machine, indicated overall by the reference numberal 1, notably comprises, as described in U.S. Pat. No. 3,521,466, a fixed structure 2 comprising a needle cylinder 3 and a disc or needle dial 4, both fixed and provided with needles, and a rotating structure 5 and 6 carrying, besides other members, the cams for controlling the needles. As shown in FIG. 1, a zone 7 of the cylinder 3 and the dial 4 is needle-free and no knitted fabric is formed in this zone. At the beginning of the needle-free zone, considering the direction of rotation of the rotating structure as indicated by the arrows in FIG. 1, there is a thread cutting device indicated overall by reference numeral 8 and not further represented as it is of known type, for example such as that described in U.S. Pat. No. 3,640,094.

According to the invention, the device for feeding thread to the needles of the cylinder 3 and disc 4 comprises a plurality of spools 9 disposed on a fixed structure 10 arranged to the side of the machine 1, and respective thread guides 11 arranged in proximity of the cylinder 3 at the needle-free zone 7. The fixed structure represented by way of example in FIG. 1 comprises pairs of parallel cross members 12 supporting the spools 9 and respective guide rings 13 for passage of the thread 14 which is unwound from each of these spools 9. The spools 9 of each row are disposed preferably staggered with respect to those of the parallel adjacent row, and in a number of overlying planes. By means of such an arrangement, it is possible to arrange any number of spools, independently of their weight or size, and this number may be much greater than that shown in the drawing and greater than the maximum number used at the present time on the machines in question. The threads 14 of the spools 9 pass successively through fixed guide means 15 disposed on one or more cross members 16 of the structure 10.

The thread guides 11 which are provided in a number equal to that of the threads, are arranged on a structure 17 which is secured to the fixed structure 2 of the machine and comprises a support 18 provided with a number of passages 19 and 19*a* for guiding the thread equal to the number of threads 14 or spools 9. For clarity of illustration, only 12 spools 9 and 12 passages 19 and 19*a* have been shown. In a position proximate to the passages 19*a* there is fixed a plate 20 provided with a number of substantially V-shaped notches 21 equal to the number of passages 19*a*. The notches 21 are located laterally of the passages 19*a* and slightly below thereof.

Figures 1A, 2:
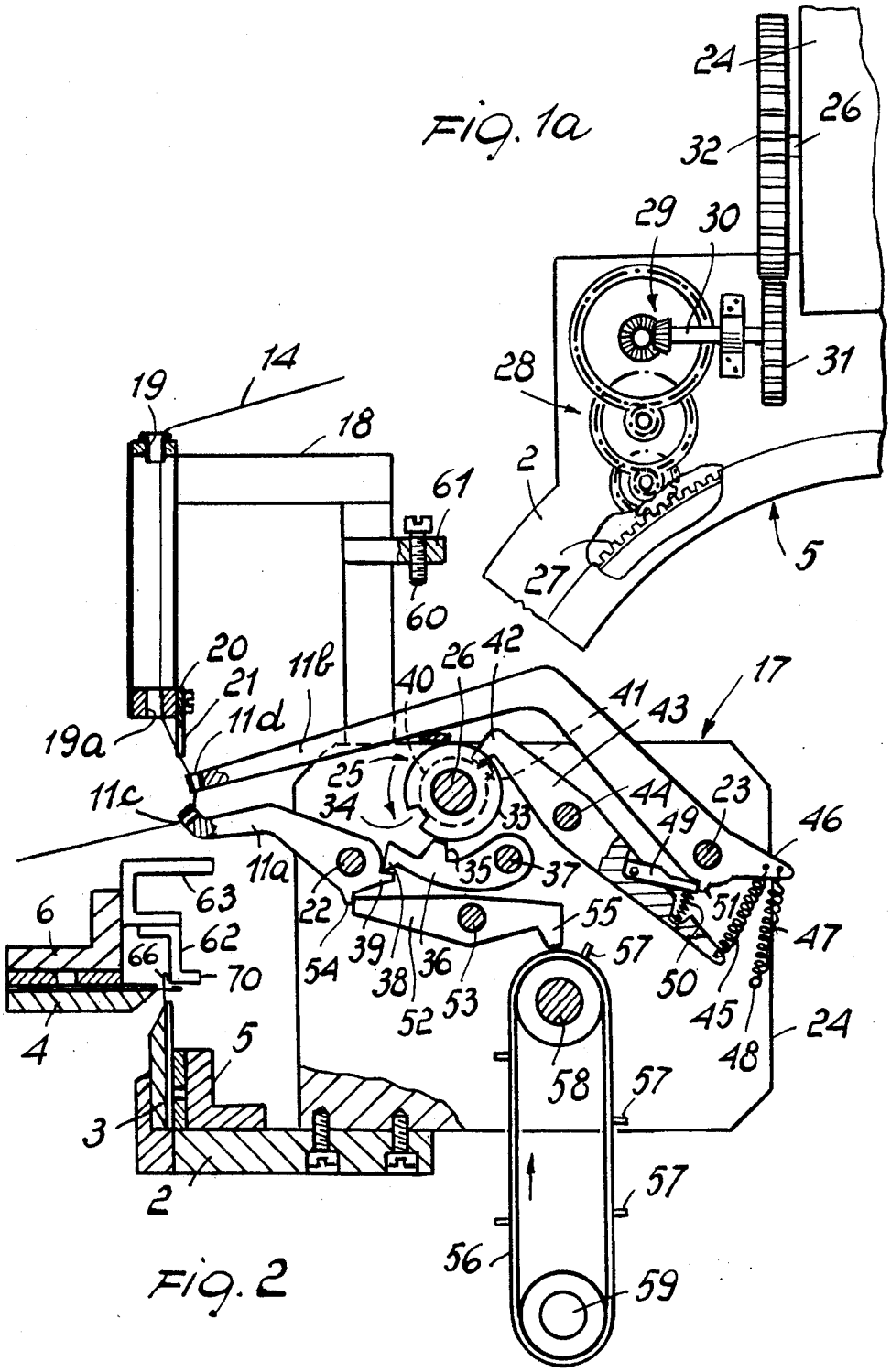

The thread guides 11 each consist of a fingle-like thread guide 11*a*, pivoted at one end to the axle 22, to which all the other analogous thread guides, not shown in FIGS. 2 and 3, are pivoted parallel and independently of each other, and of a guide lever 11*b*, pivoted at one of its ends, together with all other analogous guide levers, to the axle 23. The axles 22 and 23 are supported by support plates 24, secured to the fixed structure 2 of the machine. The thread guides 11*a* and guide levers 11*b* comprise respective passages 11*c* and 11*d* for the thread, at the ends opposite to those at which they are pivoted.

The thread guides 11*a* and guide levers 11*b* are pivotable between the two extreme angular positions shown respectively in FIGS. 2 and 3. The movement is controlled by a system of cams 25 rigid with the shaft 26, rotatably supported by the plates 24, and which is driven directly by the rotating structure 5 of the machine, as shown in particular in FIG. 1*a*. The movement is derived from a ring gear 27 rigid with the rotating structure 5, which rotates the reduction gears 28 which, by means of bevel gears 29 or an equivalent coupling, rotate the shaft 30 with the gear wheel 31 and hence the gear wheel 32, rigid with the shaft 26. The reduction ratio is chosen so that one revolution of the shaft 26, i.e., of the cams 25, corresponds to one revolution of the rotating structure 5.

The cams 25 are of two types, one for the thread guides 11*a* and one for the guide levers 11*b*, each thread guide and each guide lever having its own associated cam. The cams 33 for the thread guides 11*a* each comprise a large circular portion of constant radius and a depression 34, and are followed by a cam follower tooth 35 of a pawl 36 pivoted to a shaft 37 fixed between the plates 24. The beaked end 38 of the pawl 36 acts on a tooth 39 of the pivoted end of the thread guide 11*a*.

The cams 40 for the guide levers 11*b* comprise a large circular poriton of constant radius and a tooth 41, and are followed respectively by the beaked end 42 of a lever 43 pivoted at an intermediate point to a shaft 44 fixed between the plates 24. The end of the lever 43 opposite the beaked end 42 is connected by a spring 45 to an appendix 46 of the guide lever 11*b*. A second spring 47 with an elastic force substantially less than that of the spring 45 is disposed between the appendix 46 and a connection rod 48 fixed to the plates 24. At an intermediate point, the lever 43 comprises a pivoted lever 49 kept separated from the lever 43 by a pressure spring 50 and provided for engaging a tooth 51 of the guide lever 11*b*.

A rocker lever 52 is pivoted to an axle 53 fixed between the plates 24 and has one end provided for engaging a second tooth 54 of the thread guide 11*a* and one beaked end 55 designed to follow a chain 56 or the like provided with pegs 57 or the like disposed in accordance with a predetermined program and rotated by the machine drive members about rollers 58 and 59. The pegs 57 are disposed in a number of rows, parallel to the direction of movement of the chain, equal to the total number of threads of all feeds, so as to be able to select the desired thread of each feed, as will be more evident hereinafter.

To define the extreme stop position of the guide levers 11*b*, there is an adjustment screw 60 screwable into a bracket 61 on the support 18. The extreme non-working or rest position of each guide lever 11*b* can be adjusted independently.

Figure 4:
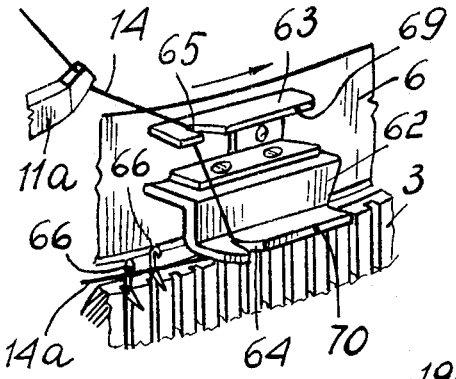

On the rotating structure 6, at regular distances and rotating with it, are disposed a number of guide means for the thread equal to the number of feeds, so that at a given time each of the guide means takes one thread only of the threads of different color associated to a given feed and directly feeds this thread to the needles. These guide means each consist of an angular plate element 62 fixed to a substantially U-shaped support 63, fixed in its turn to the rotating structure 6. Both the element 62 and the support 63 comprise respective notches 64 and 65, designed to receive the thread in order to directly feed it to the needles 66. The notches 64 and 65 define thread entrainment hooks in their respective elements for guiding these threads, which leave the respective thread guides 11*a*, about the cylinder 3 as shown diagrammatically in FIGS. 4, 6 and 7. FIGS. 6 and 7 show for reasons of clarity only some of the operative thread guides and the inoperative thread guides arranged therebetween, the inoperative thread guides being not visible in FIG. 6 as they are arranged behind the corresponding operative thread guides which have been shown exaggeratedly angularly offset in order to better understand the thread movement, which takes place without bridging but in such a manner that each new thread fed by the successive element 62 (in the direction of rotation) comes under the previous thread as the structure 6 rotates with the elements 62. The thread which becomes located above all the others is that closest to the cutting device 8 and is subsequently cut, and thus no entangling can occur between this thread and the other threads in the next revolution. The thread which has made almost one complete revolution about the cylinder has been gradually knitted by the needles, forming a row of knitting over the entire portion of the cylinder with the exception of the zone 7, and is then cut, pulled by the lever 11*b* and again fed as will be seen hereinafter.

In the needle-free zone 7, a suction port 67 is disposed between the cylinder 3 and disc 4 and extends inclined along a portion of the zone 7.

To clarify the operation of the device described, reference will be made in particular to FIGS. 5*a* to 5*f*, which show for simplicity only the members fundamentally concerned with the feed operation.

Figure 5A:
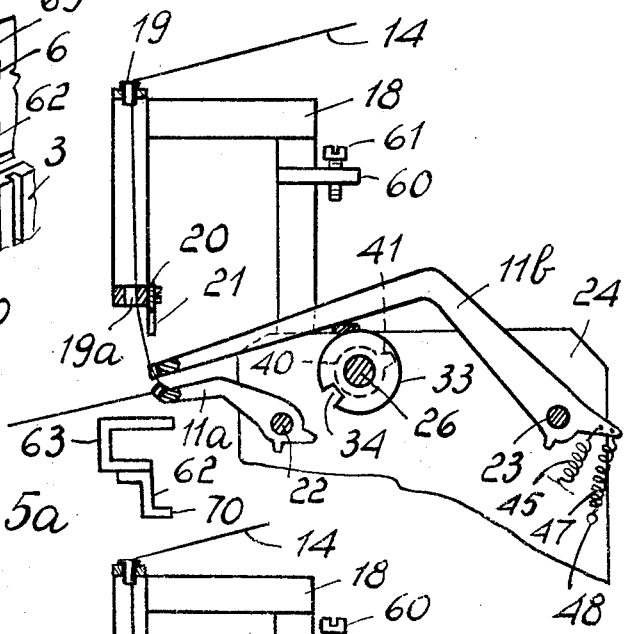
Figure 5B:
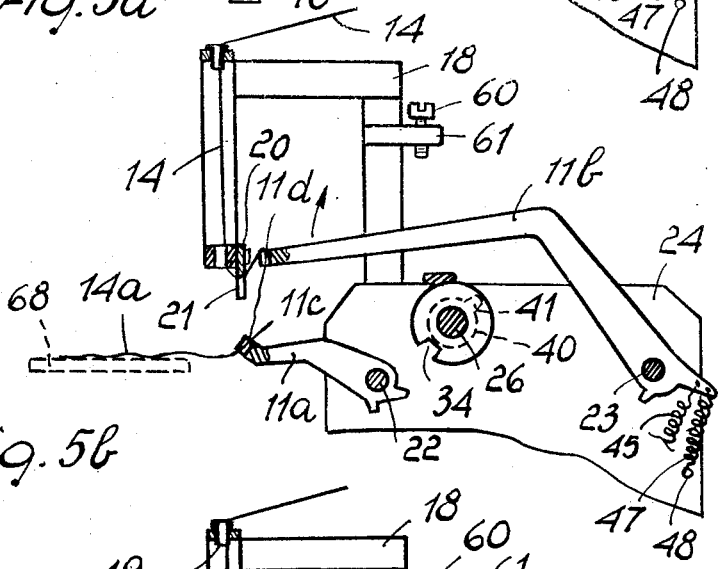
Figure 5C:
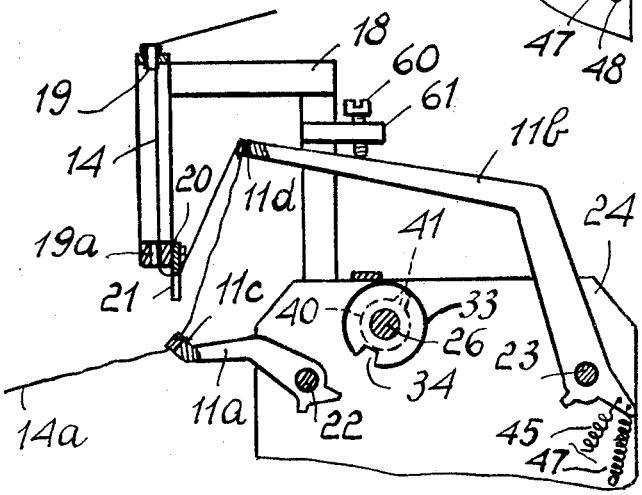

FIG. 5*a* shows the normal working position corresponding to that shown in FIG. 2, in which the thread guide 11*a* is raised above the rotating guide means 62, 63 and the guide lever 11*b* is lowered to its minimum position and is in the proximity of the thread of each feed guide 11*a*. The thread unwinds freely from the respective spool 9 through the passages 11*d* and 11*c*, and is entrained by the respective element 62 about the cylinder, where it is gradually knitted by the needles. The cam follower tooth 35 and the beaked end 42 follow the uniform circular portion of the respective cams 33 and 40, which rotate uniformly.

When the thread, having formed one row of knitting, reaches the cutting device 8, it is automatically cut. It is noted that each thread entrained by any one of the guide means 62,63 is cut by the cutting device 8 regardless of whether the thread is to be changed or not. The cutting device 8, in fact, is designed in the knitting machines of the type initially specified to cut each knitted thread regardless of the feed from which it is fed. When a thread has been cut the tooth 41 of the corresponding cam 40 has come into contact with the beaked end 42 and causes a partial clockwise rotation of the lever 43, freeing the lever 49 from the tooth 51. As there is no tension on the cut thread and no locking action of the lever 49, the corresponding guide lever 11*b*, subjected to the action of the springs 45 and 47, rotates in the clockwise direction (FIG. 5*b*) and the thread 14 is inserted into the respective notch 21 in the plate 20 and is locked therein. The rotation of the guide lever 11*b* pulls the free end 14*a* of the cut thread until the guide lever 11*b* has reached the extreme position indicated in FIG. 5*c* corresponding to the rest position, and the thread has completely returned. Advantageously a support 68, indicated by a dashed line, may be provided for supporting the cut thread or threads which are not immediately returned to knitting. The support 68 is so arranged above the needle-free sector of the needle dial 4 that the threads cut by the cutting device 8 are caused to slide on the support during clockwise rotation of the corresponding guide lever 11*b* subsequent to the cutting of the thread and rest with their end portion 14*a* on the support. By adjusting the screw 60 the extreme position of the guide lever 11*b* can be adjusted so that the free portion of thread 14*a*, considering the position which each lever has with respect to the cutting device 8 (FIG. 1), has a predetermined length which is neither excessive nor insufficient for allowing subsequent taking up of the thread for knitting, as will be seen hereinafter.

As rotation of the cams 33 and 40 continues, the tooth 41 again frees the beaked end 42, but this has no effect on the guide lever 11*b*, which remains in its position. This is because the lever 43 returns to anti-clockwise rotation and the lever 49 rests under the tooth 51 without engaging it but compressing the spring 50, while the lack of tension on the free thread 14*a* and the action of the spring 47 keep the lever 11*b* in the high position. The action of the spring 45 has been strongly reduced, as the lever 43 has returned to the position of FIG. 2 and the lever 11*b* remained high.

At this point the same thread, or another thread of the same feed , must be newly fed to the needles to form the next row. For this purpose the thread guide 11*a* corresponding to the desired thread, is lowered from rest position into feed position (FIG. 5*d*) by the action of the depression 34. This is possible only when the rocker lever 52 has met a peg 57 and has been rotated in the anticlockwise direction (FIG. 3). In this case the tooth 54 is released and the weight of the thread guide 11*a* causes an anticlockwise rotation of the thread guide and the insertion of the cam follower tooth 35 into the depression 34. If the rocker lever 52 encounters no peg 57, there will be no drop of the thread guide, even though the cam follower tooth 35 encounters the depression 34, because the engagement between the tooth 54 and lever 52 would not allow any movement of the thread guide 11*a*. Thus, from the four or five thread guides associated with one feed, it is possible to select the corresponding to the color or type of thread required each time for the next row, by prearranging a peg 57 on the chain 56 for the thread guide to be operated and leaving the pegs 57 off for the other thread guides of the same feed. This selection would not be otherwise possible because as the cams 33 have necessarily all the same contour, there would be the same control each time on all the thread guides of the same feed and the simultaneous lowering of all thread guides.

The lowering of the selected thread guide 11*a* brings the thread guide into the feed position (FIG. 5*d*) and the portion 14*a* of the thread towards the cylinder 3. The thread is immediately sucked by the suction port 67 and thus remains taut between the notch 21 in the plate 20 and the port itself. The suction action of the port is however insufficient to return the guide lever 11*b* downwards, this latter being subject to the action of the spring 47.

Immediately afterwards, the thread guide 11*a* is returned from the feed position upwards (FIG. 5*e* ) because the cam follower tooth 35 leaves the depression 34 as the cam 33 continues to rotate. The thread guide 11*a* is raised just before the respective element 62 arrives for taking up the thread. The front rounded corners and angles of the element 62 cause the thread held taut by the suction action of the port to slide along the surfaces 69, 70, making it reliably enter the notches 64 and 65 and hooking it positively. The element 62 brings the thread towards the first suitably raised needles 66 of the cylinder zone provided with needles, while the thread remains locked in the notch 21 at one end and sucked by the port 67. The thread gradually leaves the port as it approaches to the needles, and is knitted. Because of the arrangement of the suction port 67 which sucks the end of the thread to be knitted no particular pincer means for holding the thread at the beginning of the knitting is necessary.

Figures 5D, 5E, 5F:
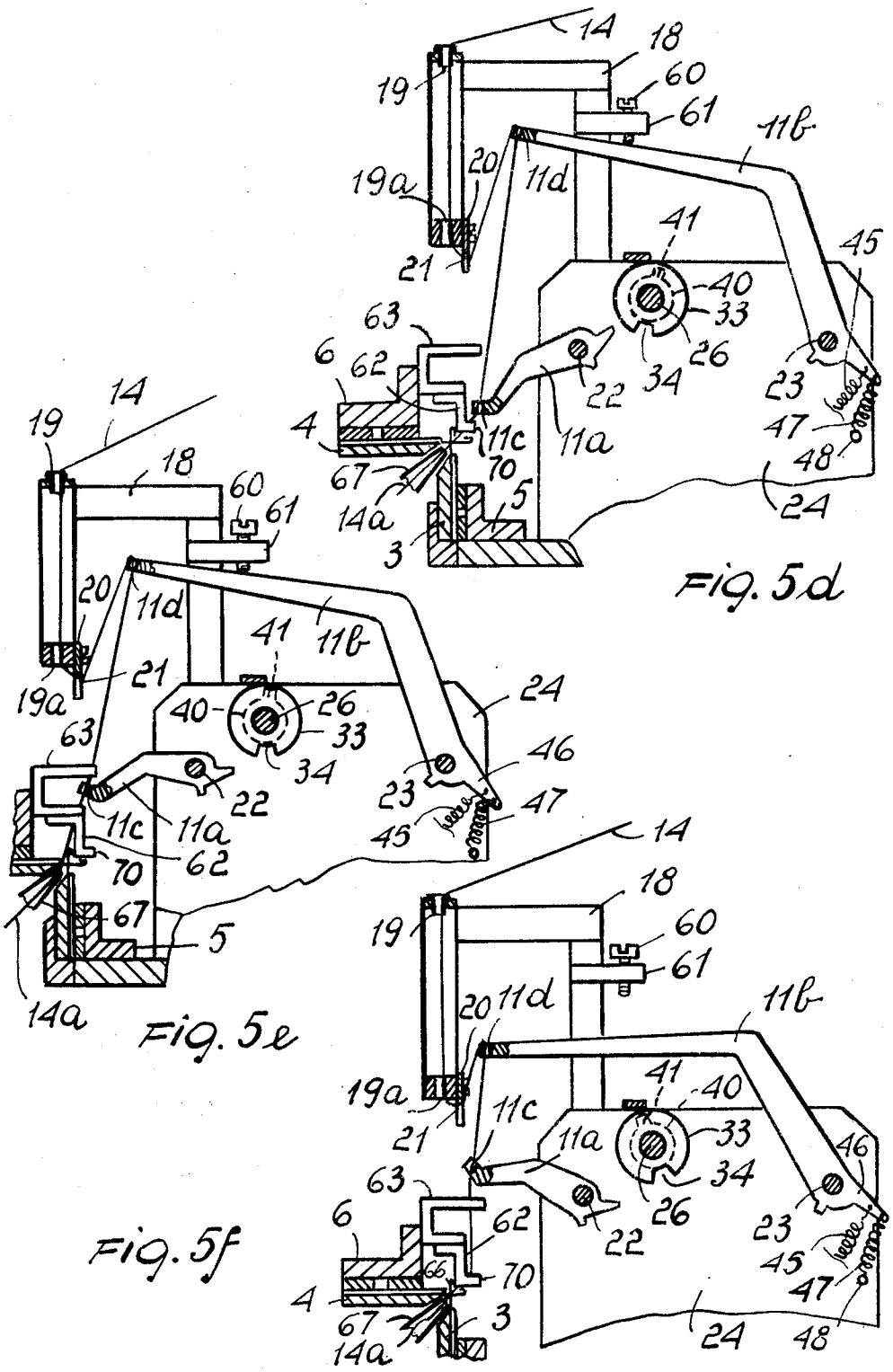

After a first thread portion has been knitted by the first needles 66, further advancement of the element 62 returns the respective guide lever 11*b* downwards against the action of the spring 47 (FIG. 5*f*). The thread continues to be knitted while the lever descends, and before the lever reaches its lowest extreme position the thread is released from the notch 21 in the plate 20, and the position shown in FIG. 2 is reached where the thread is unwound from its own spool and continues to be knitted over the entire cylinder section provided with needles. The tooth 51 is again engaged by the lever 49 and the guide lever 11*b* is locked. This avoids possible vibration of the guide lever during the manufacturing process.

The operational stages of the feed device heretofore described all take place (with the exception of the last stage shown in FIG. 5*f*) substantially in the time which a point of the rotating structure 6 takes to travel through the needle-free portion of the cylinder.

As can be seen, the only feed device means supported by the rotating structure are the elements 62 and 63, which replace the traditional thread guides and are of insignificant mass. These serve not only to grip the taut thread during their movement and to bring the thread constantly into the feeding position, but also to keep the needle latches open when they are preparing to form the stitch in that the lower edge of the element 62 facing the needle cylinder and needle dial firstly assists in opening the non-open latches of the outwardly moving needles and then maintains the latches open.

The thread guides 11*a* are preferably disposed with the thread guide ends not aligned in the same horizontal plane but at a slightly increasing level starting from the thread guide located closest to the cutting device 8. In this manner, the threads operating at the various points of the cylinder do not touch each other. The device could however operate with the thread guides perfectly aligned in a horizontal plane because the threads would pass one above the other without tangling, but there would possibly be reciprocal contact with slight rubbing.

The operating stages heretofore described are repeated for each feed, i.e., for one selected thread guide thereof and its respective associated members, once for every revolution of the rotating structure and corresponding guide means 62, 63, because one such revolution corresponds to one revolution of the shaft 26 carrying the cams 25. In other words the cams 25 of the various feeds are so phase displaced among each other that the operating stages described occur progressively for each feed as the corresponding guide means 62,63 travel through the needle-free zone 7. Where another thread has to replace one thread which has just been knitted in one revolution of the rotating structure, the stages illustrated in FIGS. 5*a* to 5*c* would occur for the thread guide and guide lever corresponding to the thread which is excluded from knitting, whereas the stages illustrated in FIGS. 5*d* to 5*f* occur for another thread guide of the same feed, suitably controlled by the action of a peg 57.

It can be seen that the continuous operation of a device such as that described, i.e., in which the structure carrying the spools of feeding thread does not rotate even though the thread is fed while rotating about the cylinder, is made possible by the fact that the thread is cut at each revolution of the rotating structure, i.e., after having formed one row, and is then retrieved without interferring with the other threads being knitted at the next revolution.

In the drawings only a few thread guides and feeding units have been shown for reasons of clarity. It will be evident however that because of the dimensions of the circular machines considered, it is possible without difficulty to arrange more than 60 thread guides and feed spools instead of the 12 thread guides and 12 spools represented, without giving rise to any problem because they are disposed in a fixed manner to the side of the machine and are not rotatably supported as in known machines. It should also be noted that at any given moment the threads being knitted are never all the threads of all the spools, but only one thread for each feed and associated guide means 62, 63 . This means that no difficulty arises in the movement of the threads, which are well spaced apart around the cylinder, and also underlines the superiority of the device according to the invention over known machines, in which not only the spools of thread actually being knitted have to be rotated at any moment, but also all the others which are not knitted at the said moment.

As the spools are disposed on a fixed structure it is possible to carry out a so-called "head-tail" operation, i.e., join the initial part of the thread of one spool to the end part of another, so increasing the overall duration of the unwinding, in that when the first spool is empty, the thread begins to unwind from the second spool. It is thus possible to reduce the frequency of used spool replacement and avoid stopping the machine each time a spool has been exhausted.

The invention is susceptible to modifications, all of which fall within the scope of the inventive idea. Thus a support structure consisting of guides, spacers or the like may be provided close to the thread guides 11*a* above the level of the elements 62, 63, for temporarily holding the cut threads before they are newly knitted.

I claim:

1. A thread feed device for circular knitting machines of the type having a fixed needle cylinder and needle dial, a rotating machine structure including control cams for the needles, a needle-free zone on said needle cylinder and needle dial and a device for cutting the thread at the beginning of said zone, the feed device including a plurality of feeding units comprising a plurality of spools of thread and respective thread guides, a fixed structure arranged to the side of the machine for supporting said plurality of spools, said thread guides being arranged in the proximity of the needle cylinder at said needle-free zone and selectively approachable to said cylinder to selectively feed the needles with a thread previously cut by said cutting device, the device further including guide means arranged on said rotating machine structure for taking the thread fed by said selected thread guides and for feeding said thread to the needles around the needle cylinder.

2. A device as claimed in claim 1, wherein said thread guides each comprise a finger-like thread guide and a guide lever which are pivoted independently of each other on a fixed support structure of the machine proximate to said needle-free zone and are provided with passages for the thread, said thread guides and said guide levers being independently pivotable between a thread feed position and a rest position.

3. A device as claimed in claim 2, comprising cam means for driving said thread guides and said guide levers between said feed and rest positions, and means for rotating said cam means synchronously with a rotating machine structure so as to carry out one complete revolution at each complete revolution of said rotating machine structure.

4. A device as claimed in claim 1, wherein said guide means each comprise an angular plate element fixed to said rotating machine structure and provided with at least one notch for taking and entraining a thread around the needle cylinder.

5. A device as claimed in claim 1, in which each of said feeding units includes several thread guides and corresponding guide levers, the device comprising a release device associated with each thread guide and operated in a programmed manner to select one of said thread guides and make it pass from a rest position to a feed position.

6. A device as claimed in claim 5, wherein said program operated release device comprises a rocker lever associated to each of said thread guides and having one end shaped for engagement with an engagement tooth of the associated thread guide and an opposed end shaped to follow programming means provided with pattern pegs or the like disposed in accordance with a thread guide selection program.

7. A device as claimed in claim 2, comprising at least one spring between each of said guide levers and said fixed support structure for the thread guides, and a device for locking said guide levers in said feed position against the action of said spring, said device comprising a lever having one end provided with a cam follower co-operating with a respective cam.

8. A device as claimed in claim 2, further comprising a guide structure for the threads arranged upstream of said guide levers and thread guides, said guide structure comprising passages for the threads and a thread locking element including a plurality of substantially V-shaped notches, one for each thread, said thread locking element being arranged at an intermediate level between said feed and rest position of said guide levers for engaging and locking the thread in said notches when the respective guide lever is in said rest position.

9. A device as claimed in claim 1, wherein said thread guides have thread guiding ends arranged at a progressively increasing height.

10. A device as claimed in claim 1, further comprising means for supporting the ends of the threads cut by said cutting device and not knitted, said means including guides, spacers or the like arranged substantially above said needle-free zone.

* * * * *